US007302996B2

(12) United States Patent
Poloni et al.

(10) Patent No.: US 7,302,996 B2
(45) Date of Patent: Dec. 4, 2007

(54) FEED DEVICE FOR FEEDING MOLTEN METAL INTO A CRYSTALLIZER

(75) Inventors: Alfredo Poloni, Fogliano Redipuglia (IT); Nuredin Kapaj, Udine (IT); Andrea De Luca, Remanzacco (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 10/563,015

(22) PCT Filed: Jul. 2, 2004

(86) PCT No.: PCT/EP2004/051339

§ 371 (c)(1),
(2), (4) Date: Dec. 28, 2005

(87) PCT Pub. No.: WO2005/002756

PCT Pub. Date: Jan. 13, 2005

(65) Prior Publication Data

US 2006/0162894 A1 Jul. 27, 2006

(30) Foreign Application Priority Data

Jul. 2, 2003 (IT) ..... MI2003A1356

(51) Int. Cl.
*B22D 11/06* (2006.01)
*B22D 11/103* (2006.01)

(52) U.S. Cl. ..... 164/428; 164/437

(58) Field of Classification Search ..... 164/488, 164/134, 437, 480, 428, 135
See application file for complete search history.

(56) References Cited

U.S. PATENT DOCUMENTS

| | | | | | |
|---|---|---|---|---|---|
| 3,887,171 | A * | 6/1975 | Neuhaus | 266/215 |
| 4,125,146 | A * | 11/1978 | Muller et al. | 164/437 |
| 4,671,499 | A * | 6/1987 | Ishiyama et al. | 266/275 |
| 4,776,570 | A * | 10/1988 | Vo Thanh et al. | 266/44 |
| 4,830,090 | A * | 5/1989 | Takeuchi et al. | 164/488 |
| 5,169,591 | A * | 12/1992 | Schmidt et al. | 266/275 |
| 5,716,538 | A * | 2/1998 | Poloni et al. | 222/606 |
| 5,794,682 | A * | 8/1998 | Damasse et al. | 164/437 |
| 6,095,233 | A | 8/2000 | Leabeater et al. | |
| 2002/0029865 | A1 * | 3/2002 | Kneppe et al. | 164/453 |
| 2005/0067134 | A1 * | 3/2005 | Brummayer et al. | 164/473 |

FOREIGN PATENT DOCUMENTS

| | | |
|---|---|---|
| DE | 863 119 | 1/1953 |
| FR | 1 447 139 | 7/1966 |
| WO | WO 03/51560 | 6/2003 |

* cited by examiner

*Primary Examiner*—Len Tran
(74) *Attorney, Agent, or Firm*—Stetina Brunda Garred & Brucker

(57) ABSTRACT

A drop feeder (1) for feeding molten metal into an ingot mould (15) comprises a distributor (3) having a substantially prismatic shape, with one of the faces open, in which the inside of the distributor comprises three tanks (4, 5, 6), separated by walls (7, 8) functioning as weir for the molten melt poured into the intermediate tank (5). There are provided slots (10) arranged on the faces of the distributor (3) for emptying of the molten metal from the distributor into the ingot mould or into a second distributor.

2 Claims, 2 Drawing Sheets

FEED DEVICE FOR FEEDING MOLTEN METAL INTO A CRYSTALLIZER

FIELD OF THE INVENTION

The invention relates to a device for discharging metal in the molten state from a container, for example from a casting ladle or a tundish, into an ingot mould of a continuous-casting line with rolls.

PRIOR ART

Normally, in continuous-casting plants, the metal arriving, in the molten state, for example from an electrical furnace, or else from a converter is made to undergo a series of operations of transfer between containers before being cast into the ingot mould in order to guarantee optimal conditions in the ingot mould so as to ensure a quality casting.

Particular problems arise in the continuous casting of metal strip using counter-rotating rolls. In this case, the steel coming out of the production furnace is collected in a casting ladle, from which it is discharged into one or more tundishes, each of which supply one or more basins of molten metal above two cooled counter-rotating crystallizer rolls, which form the ingot mould and in which the metal solidifies, coming out in the form of finished product.

It is known that the quality of the end product, and also the very carrying-out of the process can be jeopardized by the situation that arises in the ingot mould and in particular by the shape and by the fluid-dynamic situation of the metal in this area. In fact, in a two-roll continuous-casting machine, there is the need to form in the ingot mould, which consists of a substantially V-shaped vessel defined by the space between the two rolls, a meniscus of liquid metal, which is possibly uniform, homogeneous, and flat throughout the axial extension of the rolls. A uniform distribution of the liquid steel in the crystallizer and, consequently, a uniform solidification, on the one hand prevents the formation of cracks during casting, and on the other guarantees non-uniform solidification and prevents trapping of impurities, which lie at the origin of cracks in the course of the subsequent processing operations. Furthermore, the level of the liquid steel in the distributor must be such as to prevent formation of vortices on the meniscus, In so far as this would bring about trapping, in the solidified steel strip, of impurities that are present in the liquid steel and float on the meniscus. Such an eventuality would bring about the onset of defects such as cracks, surface defects, etc. that could be accentuated in the course of the subsequent processing operations that the product has to undergo, for example, rolling, forming, etc.

Discharge devices of the known art that have been designed to address the above problems are of a complex shape and are difficult to build, in addition to involving the need for considerable maintenance operations. Uniformity of distribution has also been achieved with the use of a number of containers arranged in series, in order to reduce in this way the speed at which the liquid steel is fed. This solution, however, complicates the casting plant. Consequently, there is felt the need to have available discharge devices which will at the same time be easy to build and will contribute to a uniform outflow of the liquid metal, so guaranteeing formation and maintenance of a uniform meniscus in the ingot mould in order to obtain an end product that is free from defects.

SUMMARY OF THE INVENTION

It is hence a purpose of the present invention to furnish a remedy to the problems referred to above by providing a device for feeding molten metal starting from a container, for example a tundish, which will produce a flow of molten metal into the ingot mould that is free from any turbulence for formation of a meniscus that is as uniform as possible.

A further purpose is to provide a feed device having an alternative shape that will have a simple design and will prevent need for use of a number of containers arranged in series along the casting flow in order to reduce the speed of inflow of the liquid steel.

The problems set forth above have been solved in accordance with the main claim by means of a drop feed device for supplying an ingot mould with molten metal, comprising a distributor having a substantially prismatic shape, with one of the faces open, in which the inside of the distributor comprises at least three tanks, of which two first tanks are arranged at the ends of the distributor and at least one further tank is set in an intermediate position with respect to the first two tanks, in which the further intermediate tank is separated from the first two tanks by respective separating walls, the dimensions of which are such as to cause one of their edges to perform a function of weir for passage of the molten metal between said intermediate tank, when it is full, and said two first tanks, in which there are provided holes arranged on one or more faces of the distributor in such a position and of such dimensions and shape as to be able to perform a function of emptying the molten metal from said two first tanks towards the outside of the distributor before reaching a level equal to that of the edge of each of the separating walls which perform the function of weir.

Thanks to the particularly simple and compact shape of the feed device that comprises an intermediate distributor downstream of the discharger and thanks to the arrangement of the tanks that make up said distributor, a homogeneous flow of liquid steel is generated during discharge.

The task of the first tank is to reduce the kinetic energy of the liquid steel pouring from the tundish. Also the arrangement and shape of the side slots guarantee a sufficient rate to maintain the speed of casting according to design.

A further improvement of the flow is obtained by means of a feed device that comprises also the use of a main distributor downstream of the intermediate distributor. In this way, the flow of steel that is poured into the ingot mould can further be rendered uniform and homogeneous. The result is thus a meniscus without any swirling motion that ensures the production of a casting product of higher quality.

LIST OF FIGURES

Further advantages that may be achieved with the present invention will emerge more clearly to the person skilled in the sector from the ensuing detailed description of a non-limiting example of a particular embodiment of the discharge device, with reference to the following figures, in which.

DETAILED DESCRIPTION OF A PREFERRED EMBODIMENT

Figure 2:
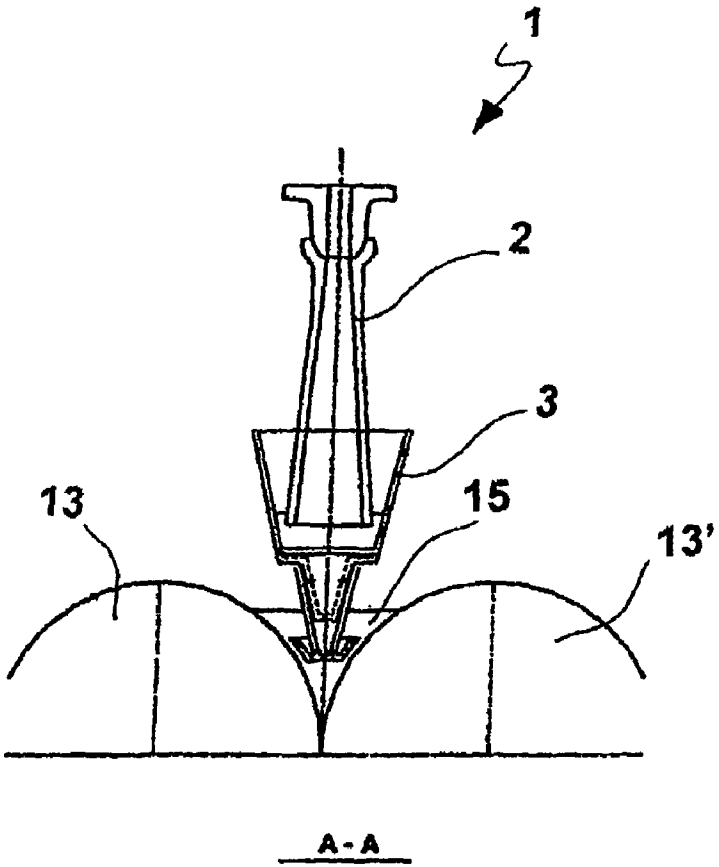
FIG. 2 shows a cross section according to the vertical plane of trace A-A of the casting machine of FIG. 1.
Figure 1:
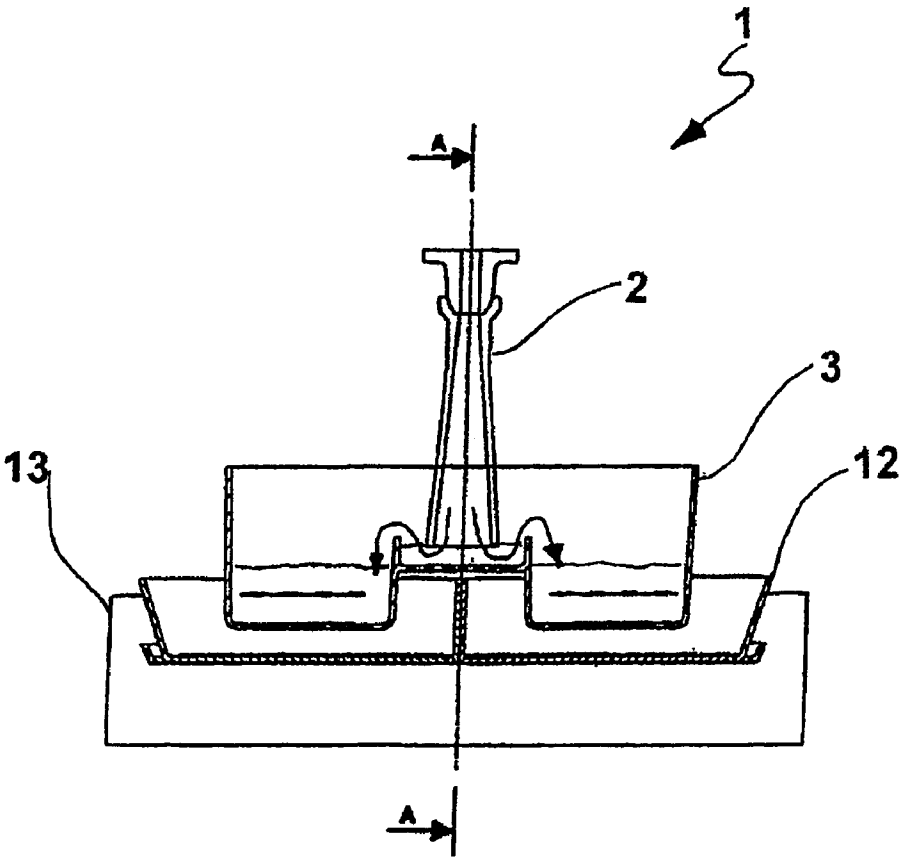
FIG. 1 shows a cross section according to the vertical plane of casting of a continuous-casting machine that comprises the feed device according to the invention.

With reference to the figures, described herein is an embodiment of a feed device for feeding molten metal, in particular liquid steel, into an ingot mould for a continuous-casting machine with two crystallizer rolls. In particular, FIG. 1 shows a cross section according to a vertical plane parallel to the axis of the crystallizer rolls of parts of a continuous-casting machine, designated, as a whole, by the reference number 1, comprising the feed device according to the invention. In the remainder of the description, reference will be made to steel, but it is understood that the device can be adapted to the discharge of other metals for which the same casting technique is used.

The molten steel coming from a tundish, not represented in the figures, is poured, through a discharger 2, into a first distributor 3. The discharger 2 is substantially shaped like a funnel turned upside-down with the divergent section set downwards in the direction of the distributor 3, and has a section orthogonal to its axis that is circular. Alternatively, the cross section is circular in the top portion of the discharger and has a rectangular development towards its bottom portion, the various sections being appropriately radiused along the axial development of the discharger 2. The angle of divergence of the internal walls is less than 70°.

This arrangement of the discharger 2 produces the advantage of reducing the speed of fall of the liquid steel when it arrives in the distributor. Furthermore, the pattern of the various sections and the angle of divergence are chosen in such a way that any detachment from the internal wall of the discharger 2 is prevented.

Figure 4:
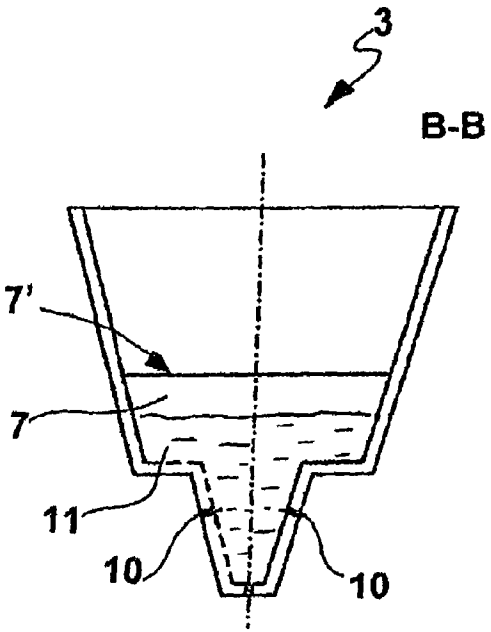
FIG. 4 shows a cross section according to the vertical plane of trace B-B of the feed device of FIG. 3.
Figure 3:
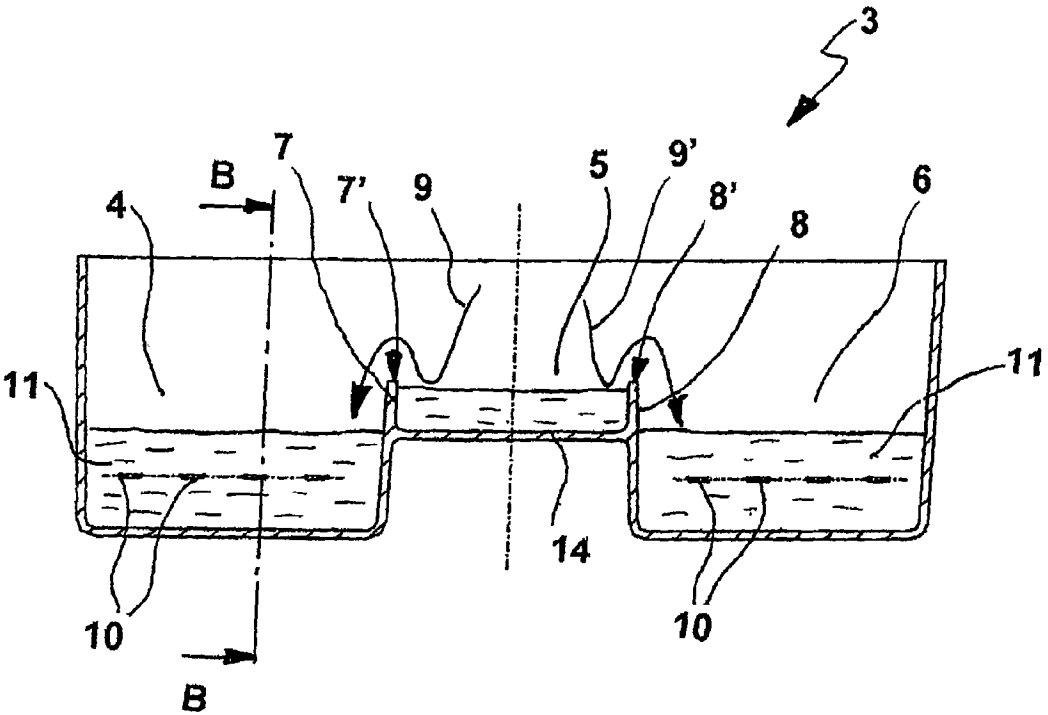
FIG. 3 shows a cross section according to the vertical plane of casting of a feed device according to the invention.

The first distributor 3, illustrated in greater detail in FIGS. 3 and 4, is a container open in the top part and having a rectangular shape in plan view, with the longer part set along the axis parallel to the directrices of the rolls. The first distributor 3 is divided on the inside, along its longer dimension, into a number of tanks, which in the embodiment illustrated in the figures are three, but which in other embodiments may be of a larger number. The discharger pours the steel into the central tank 5, delimited by two walls 7, 8, which separate It, respectively, from the end tanks 4 and 6. The separation walls 7, 8 are lower than the external perimetral walls of the central tank 3, so that, with their respective top edges 7', 8', they are able to perform a function of weir for the molten steel poured from the discharger 2. In operation, when the central tank 5 is filled with steel, the flow after the impact with the bottom of the central tank 5 follows a pattern that enables overflow beyond the weir walls 7 and 8, thus losing a major part of its kinetic energy, and subsequently flows into the end tanks 4 and 6, where there is a further stage of reduction of the kinetic energy of the steel, which reaches a more tranquil state. The pattern of the flow between the central tank 5 and the end tanks 4 and 6 is indicated schematically by the flow lines 9, 9'. The walls 7, 8 may have a height from the bottom of the central tank ranging preferably from 10 mm to 70 mm, according to the casting requirements, for example, the speed of casting and the dimensions of the steel strip to be produced.

From the end tanks 4 and 6, the liquid steel 11 flows, through series of slots 10 arranged in the bottom part of the side walls of the tanks 4, 6, into a second distributor 12, of a known form and hence not further described herein, from which there is performed discharge into the ingot mould formed by the space comprised between the counter-rotating crystallizer rolls 13, 13'. The number, shape, and dimensions of the slots 10 vary both according to the metal to be molten and according to the speed of outflow necessary in the casting machine. The discharge slots 10 can be arranged in various positions on the external walls of the end tanks 4 and 6, as likewise on the external end walls of the distributor 3. They are appropriately distributed so as to ensure a uniform, homogeneous, and non-turbulent distribution of the steel.

Advantageously, the distributor 3 has all its side faces inclined so as to be convergent, or alternatively, just some of the walls are convergent, and in this case a variant distributor is obtained, which presents a combination with some vertical walls.

Whenever envisaged, the second distributor 12 in operation is generally set Immersed in the ingot mould 15. Then, the steel strip of indefinite length is produced from the ingot mould via the continuous-casting process, in a known way.

According to a second advantageous variant of the invention, the steel flows from the first distributor 3, through the slots 10, directly into the ingot mould 15, without the presence of the second distributor 12.

According to a further advantageous variant of the feed device of the invention, the central tank 5 has a depth smaller than that of the end tanks 4 and 6, and this is obtained, for example, by locating the bottom 14 of the tank in a position that is set in with respect to the end tanks 4 and 6.

The invention claimed is:

1. A drop feed device, for a two-roll continuous strip casting machine, for feeding an ingot mould with molten metal, comprising a first distributor, having a substantially prismatic shape with one open face and having a rectangular shape in plan view, with elongated holes, having the shape of a slot, arranged on one or more side walls of the first distributor, the inside of the first distributor comprises at least three tanks, arranged along its longer dimension wherein two first tanks are arranged at the end of the first distributor and at least one intermediate tank set in an intermediate position with respect to the two first tanks wherein the intermediate tank is separated from the two first tanks by respective separating walls, whose the dimensions are such as to cause their edges to perform a function of weir for passage of the molten metal between said intermediate tank, when it is full, and said two first tanks, and in that the holes are arranged in such a position and are of such dimensions and shape as to be able to perform a function of emptying the molten metal from said two first tanks towards the outside of the first distributor before reaching a level equal to that of the edges of the separating walls, the drop feed device further comprising:

a second distributor having an elongated, substantially prismatic shape between the first distributor and the ingot mould, wherein the first distributor is immersed in the second distributor;

a discharger having a funnel-like shape, with an angle of divergence of its internal walls smaller than 7°, for discharging molten metal from a tundish or other container into the intermediate tank.

2. The device according to claim 1, wherein some or all of the faces of the distributor (3) are mutually convergent.

* * * * *